US006681737B2

(12) United States Patent
Shinoda et al.

(10) Patent No.: US 6,681,737 B2
(45) Date of Patent: Jan. 27, 2004

(54) ENGINE LUBRICATION SYSTEM

(75) Inventors: Akihisa Shinoda, Wako (JP); Hiroshi Moriyama, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 72 days.

(21) Appl. No.: 10/076,083

(22) Filed: Feb. 15, 2002

(65) Prior Publication Data

US 2002/0121261 A1 Sep. 5, 2002

(30) Foreign Application Priority Data

Feb. 20, 2001 (JP) ..... 2001-043176

(51) Int. Cl.[7] ..... F01M 9/06; F01M 1/02
(52) U.S. Cl. ..... 123/196 R; 123/196 M
(58) Field of Search ..... 123/196 R, 196 M

(56) References Cited

U.S. PATENT DOCUMENTS

| | | | | |
|---|---|---|---|---|
| 4,493,661 A | * | 1/1985 | Iwai | 123/196 R |
| 4,576,126 A | * | 3/1986 | Ancheta | 123/196 R |
| 4,622,935 A | * | 11/1986 | Janisch | 123/196 R |
| 4,628,878 A | * | 12/1986 | Nakano et al. | 123/196 R |
| 4,984,544 A | * | 1/1991 | DeBiasse | 123/196 R |
| 5,094,201 A | * | 3/1992 | Bedi | 123/196 R |
| 5,511,523 A | * | 4/1996 | Masuda | 123/196 R |
| 5,960,764 A | | 10/1999 | Araki | |
| 6,041,752 A | * | 3/2000 | Van Klompenburg | 123/196 R |
| 6,161,515 A | * | 12/2000 | Kopec | 123/196 R |

FOREIGN PATENT DOCUMENTS

| | | |
|---|---|---|
| EP | 0 839 992 A1 | 5/1998 |
| EP | 1 092 852 A2 | 4/2001 |

OTHER PUBLICATIONS

Patent Abstracts of Japan, vol. 2000, No. 16, May 8, 2001 & JP 2001 020713 A, Jan. 23, 2001.
Patent Abstracts of Japan, vol. 014, No. 488 (M–1039), Oct. 24, 1990 & JP 02 199210 A, Aug. 7, 1990.
Patent Abstracts of Japan, vol. 017, No. 407 (M–1454), Jul. 29, 1993 & JP 05 079314 A, Mar. 30, 1993.

* cited by examiner

*Primary Examiner*—Henry C. Yuen
*Assistant Examiner*—Jason Benton
(74) *Attorney, Agent, or Firm*—Arent Fox Kintner Plotkin & Kahn, PLLC

(57) ABSTRACT

An engine lubrication system has an arrangement in which the base of a crankcase is used to form an oil reservoir, and a part of an oil slinger that is driven by a crankshaft via a transmission system is immersed in the oil within the oil reservoir. An oil pump that is driven by the transmission system is immersed in the oil within the oil reservoir, and a discharge port of the oil pump communicates with a lubricating-oil passage within the crankshaft. It is thereby possible to provide an engine lubrication system based on a splash-type lubrication system while at the same time using a forced-type lubrication system, thus reducing the capacity of the oil pump and simplifying the drive system, and effectively suppressing an increase in the overall cost.

7 Claims, 6 Drawing Sheets

ENGINE LUBRICATION SYSTEM

BACKGROUND OF THE INVENTION

1. Field of the Invention

The present invention relates to an engine lubrication system in which the base of a crankcase supporting a crankshaft forms an oil reservoir, a part of an oil slinger that is driven by the crankshaft via a transmission system is immersed in oil within the oil reservoir, and the interior of the engine is lubricated with splashed oil generated by rotation of the oil slinger.

2. Description of the Related Art

A splash-type lubrication system employing an oil slinger is known in, for example, Japanese Utility Model Registration Application Laid-open No. 62-34108. A forced lubrication system is also known in, for example, Japanese Patent Registration No. 2772794. In a forced lubrication system, oil that is drawn from an oil reservoir is fed by pressure using an oil pump to all the sections of an engine that are to be lubricated, such as the circumference of a crankshaft and a valve-operating mechanism.

The splash-type lubrication system has a simple structure and can be obtained at a comparatively low cost. However, since a transmission system for driving the oil slinger is connected to a crankshaft, it is generally difficult to arrange the oil slinger in the central area of the oil reservoir. It is therefore necessary for the amount of oil that is stored in the oil reservoir to be set at an adequate level so that the oil slinger is not exposed above the liquid level even when the engine is operated in a tilted state. As a result, when the engine is operated in a normal horizontal state, the oil slinger is immersed in the oil at too great an extent, thereby causing a loss of motive power due to the resistance in stirring of the oil slinger.

In the forced lubrication system, oil discharged from the oil pump can be supplied to all the sections of the engine that are to be lubricated without being influenced by changes in the operational attitude of the engine. However, such an oil pump that can supply oil to all the sections of the engine that are to be lubricated inevitably has a large capacity, thereby increasing the cost.

SUMMARY OF THE INVENTION

The present invention has been carried out in view of the above-mentioned circumstances. It is an object of the present invention to provide an engine lubrication system based on a splash-type lubrication system which, in order to compensate for the drawbacks thereof, is combined with a forced-type lubrication system. As a result of the present invention, the capacity of the oil pump is reduced and the drive system is simplified, thereby effectively avoiding an increase in the overall cost of the engine.

In order to accomplish the above-mentioned object, in accordance with a first aspect of the present invention, there is proposed an engine lubrication system in which the base of a crankcase supporting a crankshaft forms an oil reservoir. A part of an oil slinger that is driven by the crankshaft via a transmission system is immersed in oil within the oil reservoir, and the interior of the engine is lubricated with splashed oil generated by rotation of the oil slinger. An oil pump that is driven by the transmission system is immersed in the oil within the oil reservoir, and a discharge port of the oil pump communicates with a lubricating-oil passage within the crankshaft.

In accordance with the above-mentioned first aspect, even if the extent to which the oil slinger is immersed in the oil becomes extremely low when the engine is operated in a tilted state, and the amount of splashed oil decreases, since the oil pump, which is completely immersed in the oil within the oil reservoir, operates to continuously supply the oil to the crankshaft, the sections of the crankshaft that bear a high load can still be provided with forced lubrication, and operation of the engine can be carried out continuously without any problems. It is therefore possible to set the amount of oil stored in the oil reservoir as low as possible without taking the engine tilt attitude into consideration, thereby achieving a reduction in the loss of motive power due to the resistance in stirring of the oil slinger.

Furthermore, since the oil pump is employed only for lubrication of the circumference of the crankshaft, a pump with a comparatively small capacity will suffice and can be obtained at a low cost. Moreover, since the oil pump is driven using the transmission system that drives the oil slinger, it is unnecessary to employ a transmission system exclusively used for the oil pump. It is therefore possible to effectively avoid an increase in the cost of the engine despite the combined use of forced lubrication.

Furthermore, in accordance with a second aspect of the present invention, there is proposed an engine lubrication system wherein the crankcase is equipped with an oil filter, a first oil pipe and a second oil pipe. The first oil pipe and the second oil pipe are disposed within the crankcase. The first oil pipe connects the discharge port of the oil pump to a crankcase inlet port which communicates with an unpurified chamber of the oil filter, while the second oil pipe connects the lubricating-oil passage to a crankcase outlet port which communicates with a purified chamber of the oil filter.

In accordance with the above-mentioned second aspect, even when there is oil leakage from the first and second oil pipes and the joints thereof, the leaked oil is returned immediately to the oil reservoir, thereby reliably preventing leakage to the outside.

Furthermore, in accordance with a third aspect of the present invention, there is proposed an engine lubrication system wherein an oil pressure sensor is connected to an oil passage that communicates with the discharge port of the oil pump. The oil pressure sensor generates an alert signal when the discharge pressure of the oil pump becomes equal to or less than a predetermined value during operation of the engine. A leak hole is provided in a side wall of an intake port of the oil pump. The leak hole is exposed above the liquid level when the liquid level of the oil reservoir becomes equal to or less than a predetermined alert level.

In accordance with the above-mentioned third aspect, when the liquid level of the oil reservoir drops to the alert level or below the alert level, the leak hole in the oil pump, communicates with the intake port of the oil pump is exposed above the liquid level of the oil reservoir. Air is therefore taken into the crankcase through the leak hole, and the discharge pressure thereby becomes equal to or less than the predetermined value. The oil pressure sensor detects the decrease in the discharge pressure and then operates its alerting device, thereby informing the operator of the need for the oil reservoir to be replenished with oil.

Furthermore, in addition to the above-mentioned third aspect, in accordance with a fourth aspect of the present invention, there is proposed an engine lubrication system wherein the oil slinger is arranged so that a lower end thereof is positioned beneath the leak hole.

In accordance with the above-mentioned fourth aspect, even during the above-mentioned alert state, the oil slinger can still splash oil and continue splash-lubrication.

The above-mentioned object, other objects, characteristics and advantages of the present invention will become apparent from an explanation of a preferred embodiment that will be described in detail below by reference to the appended drawings.

DETAILED DESCRIPTION OF INVENTION

One embodiment of the present invention is explained below by reference to the appended drawings.

Figure 1:
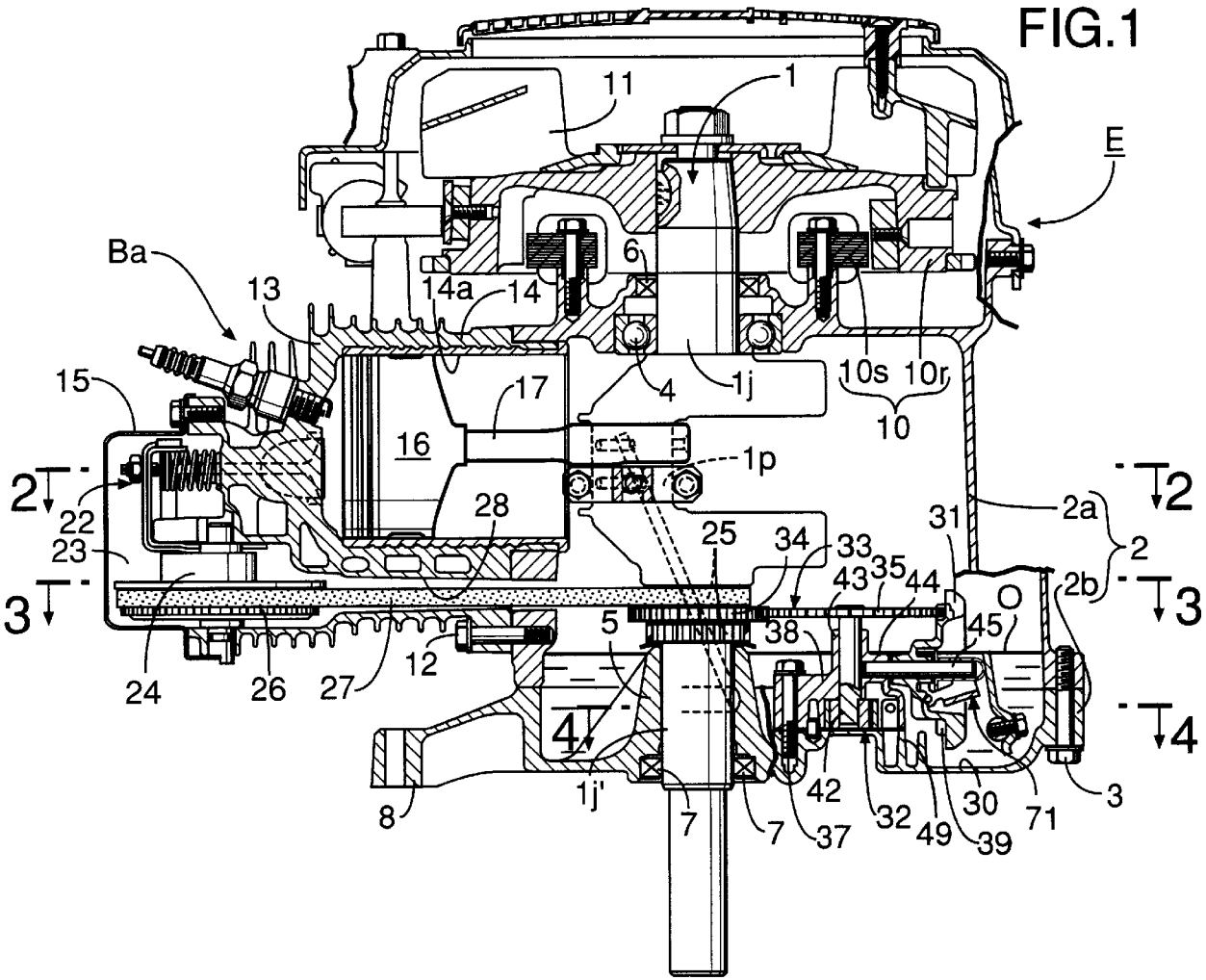
FIG. 1 is a longitudinal section side view of a vertical type engine equipped with a lubrication system of the present invention.
Figure 2:
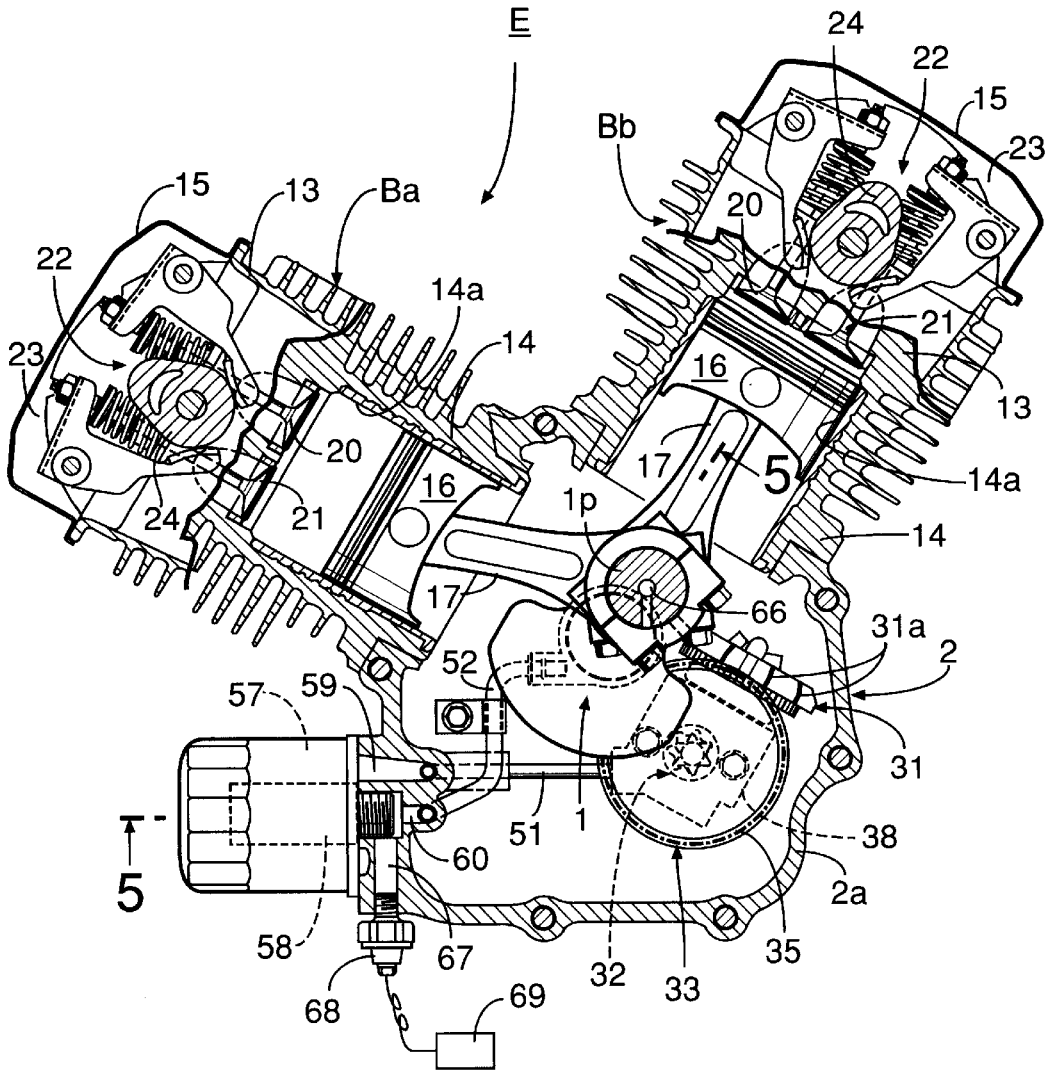
FIG. 2 is a cross section at line 2—2 in FIG. 1.
Figure 3:
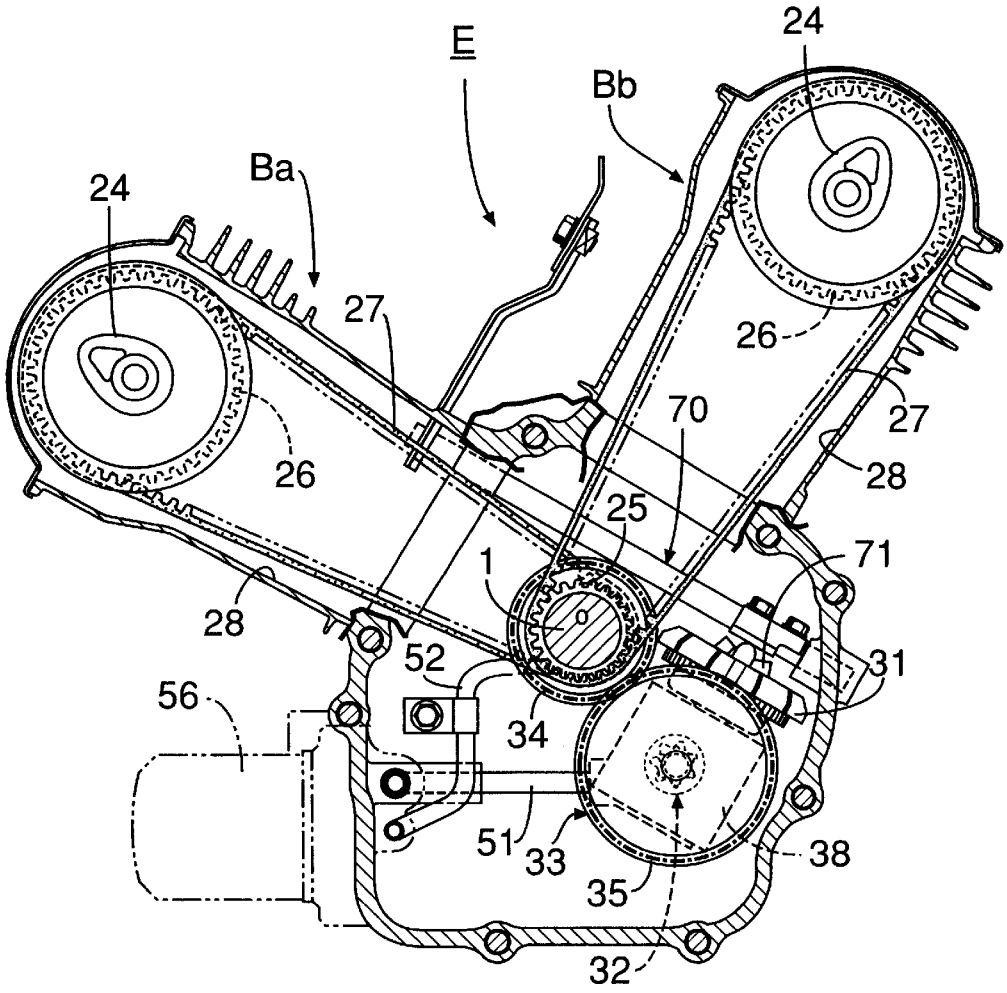
FIG. 3 is a cross section at line 3—3 in FIG. 1.

In FIGS. 1 to 3, a vertical type engine E includes a crankcase 2 supporting a vertically disposed crankshaft 1, and a pair of left and right banks Ba and Bb that extend in a V-shaped manner from a side wall of the crankcase 2. The crankcase 2 is formed from a crankcase main body 2*a* having an open lower face, and a cover 2*b* that is joined to the lower end of the crankcase main body 2*a* by a bolt 3. Upper and lower journals 1*j* and 1*j*' of the crankshaft 1 are rotatably supported by a ball bearing 4 mounted in the top wall of the crankcase main body 2*a* and a bearing boss 5 formed on the cover 2*b* respectively. An upper oil seal 6 is provided outside the ball bearing 4, and a lower oil seal 7 is provided in an outer part on the inner circumference of the bearing boss 5.

Integrally formed on the cover 2*b* is a bracket 8 for fixing the engine to the frame of various types of work machine. The lower end of the crankshaft 1 that projects beneath the cover 2*b* forms the output section that drives the various types of work machines. Fixed to the upper end of the crankshaft 1 is a rotor 10*r* of a power generator 10 together with a cooling fan 11. A stator 10*s* of the power generator 10 is attached to the upper end face of the crankcase main body 2*a*.

Each of the banks Ba and Bb has a cylinder block 14 integrally including a head 13 and a head cover 15 that is joined to the end face of the head 13. The cylinder block 14 is joined to the side wall of the crankcase 2 by a bolt 12. A piston 16 that is slidably fitted in a cylinder bore 14*a* of the cylinder block 14 is connected to a crankpin 1*p* of the crankshaft 1 via a connecting rod 17. In this case, the connecting rods 17 of the left and right banks Ba and Bb are connected to the same crankpin 1*p*.

Each of the heads 13 is provided with an intake valve 20 and an exhaust valve 21. A valve-operating mechanism 22 for opening and closing the valves 20 and 21 is arranged in a valve operation chamber 23 disposed between the head 13 and the head cover 15. A camshaft 24 of the valve-operating mechanism 22 is rotatably supported in a corresponding head 13 of the cylinder block 14 so as to be parallel to the crankshaft 1.

A pair of upper and lower drive timing pulleys 25 are fixed to a lower part of the crankshaft 1 within the crankcase 2. A driven timing pulley 26 is fixed to a lower part of the camshaft 24 in each of the valve operation chambers 23 in the left and right banks Ba and Bb. Timing belts 27 are wrapped around the left and right driven pulleys 26 and the corresponding upper and lower drive timing pulleys 25. These timing belts 27 are arranged so that they pass through belt passages 28 that are formed in side walls of the lower parts of the corresponding banks Bb and Ba so as to provide communication between the interior of the crankcase 2 and the valve operation chambers 23.

A lubrication system for the engine E is now explained.

As shown in FIGS. 1, 2, 5 and 6, the base of the crankcase 2 is used to form an oil reservoir 30. Immersed in lubricating oil O stored in the oil reservoir 30 is a part of a splashing vane 31*a* of an oil slinger 31 having a horizontal axis and the whole of an oil pump 32 having a vertical axis. The oil slinger 31 and oil pump 32 are driven by the crankshaft 1 via a common transmission system 33. The transmission system 33 is formed from a drive gear 34 and a driven gear 35 meshing with the drive gear 34. The drive gear 34 is fixed to the crankshaft 1 between the pair of drive timing pulleys 25. A pump drive shaft 42 of the oil pump 32 is fixed to the center of the driven gear 35. The driven gear 35 also meshes with a slinger gear 39 formed integrally on the side face of the oil slinger 31.

The oil pump 32 is of a trochoidal type and is formed from a pump housing 38, an outer rotor 40 and an inner rotor 41, the inner rotor having outer teeth that mesh with the inner teeth of the outer rotor 40. The pump housing 38 is joined by a bolt 37 to a horizontal pump mounting surface 36 that is formed on the cover 2*b* so as to be stepped higher than the bottom of the oil reservoir 30. The outer rotor 40 is rotatably attached to the pump housing 38. The upper end of the pump drive shaft 42 connected to the inner rotor 41 is joined by caulking to the driven gear 35. A vertical boss 43 integrally formed on the top wall of the pump housing 38 rotatably supports the pump drive shaft 42. Integrally formed on the side wall of the vertical boss 43 is a horizontal boss 44, which rotatably supports a support shaft 45, joined to the center of the oil slinger 31.

Figure 4:
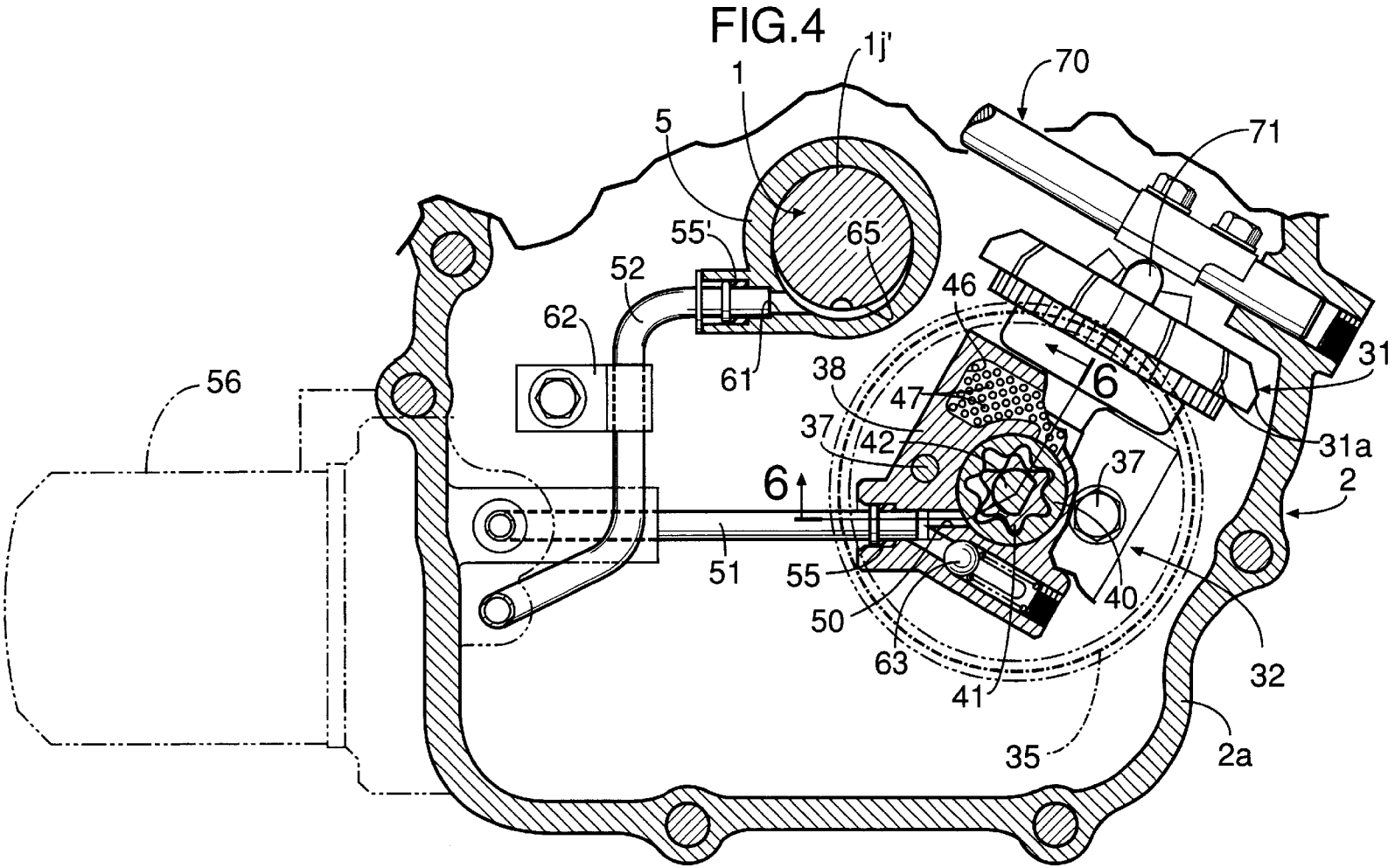
FIG. 4 is a cross section at line 4—4 in FIG. 1.
Figure 6:
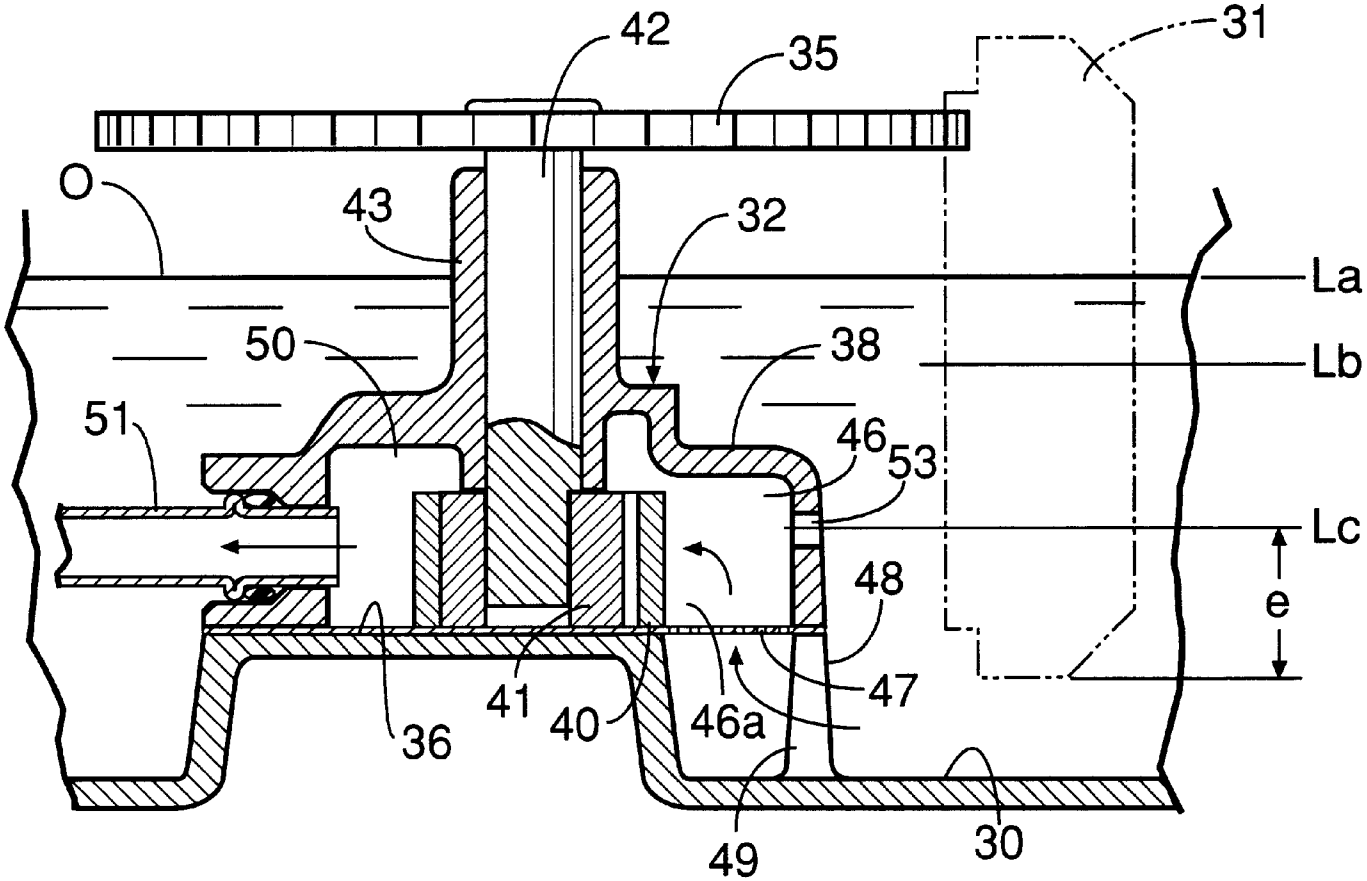
FIG. 6 is a cross section at line 6—6 in FIG. 4.

In FIGS. 1, 4 and 6, an entrance 46*a* of an intake port 46 formed in the pump housing 38 opens toward the bottom of the oil reservoir 30. The entrance 46*a* is equipped with an oil strainer 47 formed from a punched plate held between the pump mounting surface 36 and the pump housing 38. Projectingly provided on the bottom of the oil reservoir 30 is a rib 48 surrounding the entrance 46*a*. The rib 48 is provided with a notch 49, and the oil O is admitted into the oil reservoir 30 through the notch 49.

A leak hole 53 is bored in the side wall of the intake port 46 allowing communication between the inside and the outside of the intake port 46. The leak hole 53 is exposed above the liquid level of the oil reservoir 30 when the liquid level becomes equal to or less than a predetermined alert level Lc. The oil slinger 31 is arranged so that its lower end is positioned beneath the alert level Lc, namely, the leak hole 53, by a predetermined distance e.

Fitted into a discharge port 50 formed in the pump housing 38, via a seal 55, is one end of a first oil pipe 51. Attached to the pump housing 38 is a relief valve 63 (FIG. 4) that opens when the pressure in the discharge port 50 becomes excessive, thus releasing the surplus pressure into the crankcase 2.

Figure 5:
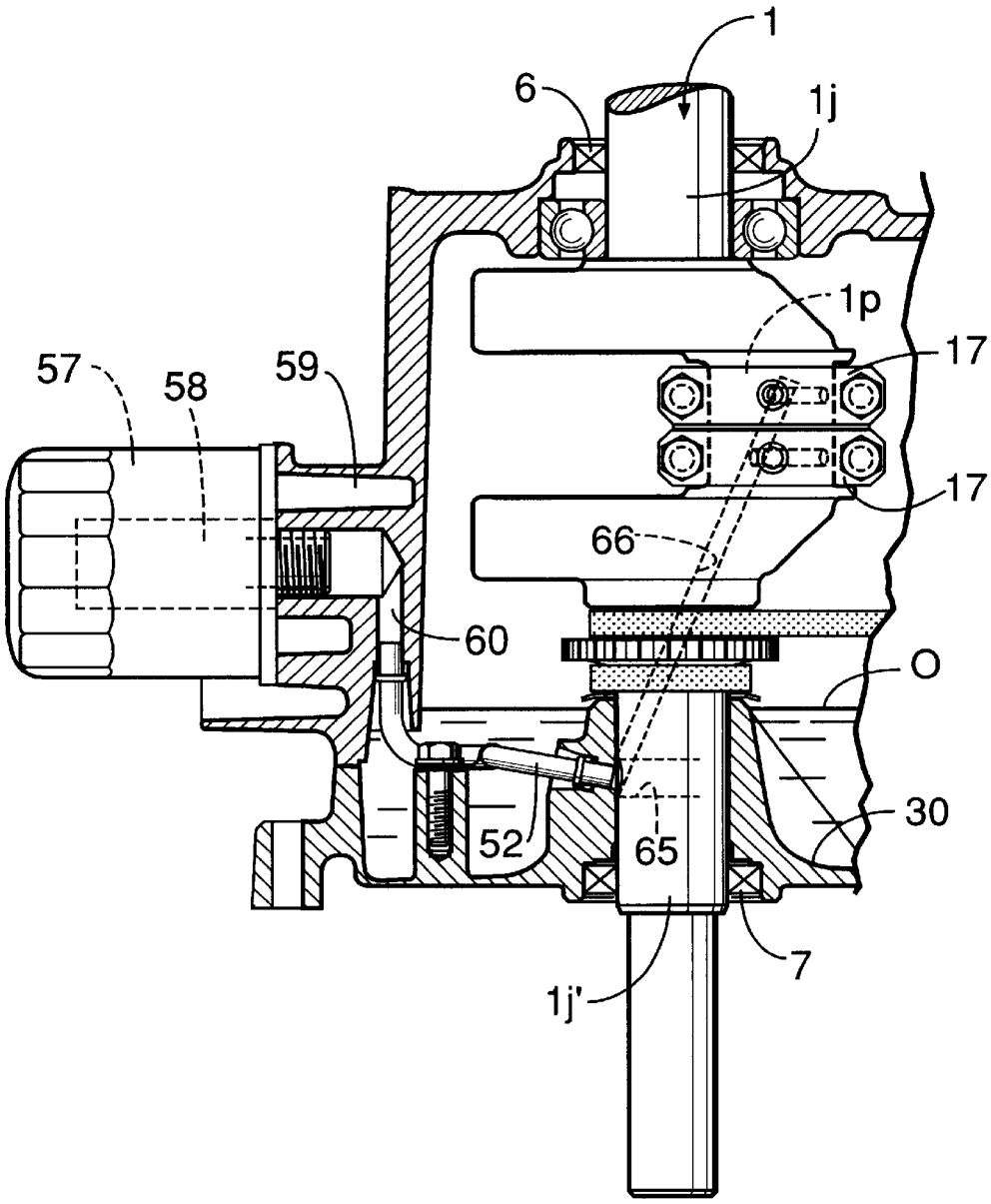
FIG. 5 is a cross section at line 5—5 in FIG. 2.

As shown in FIGS. 2 and 5, an inlet port 59 and an outlet port 60 are provided in the side wall of the crankcase 2*a* to which an oil filter 56 is attached. The inlet port 59 and outlet port 60 communicate with an unpurified chamber 57 and a purified chamber 58, respectively, of the oil filter 56. The other end of the first oil pipe 51 is fitted into the inlet port 59.

One end of a second oil pipe 52 is fitted into the outlet port 60. The other end of the second oil pipe 52 is fitted, via a seal 55', into an oil passage entrance 61 formed in the bearing boss 5. The first and second oil pipes 51 and 52 and their joints are thus arranged within the crankcase 2. The second oil pipe 52 is bent into a cranked state, and a middle section thereof is supported by a support piece 62 fixed to the cover 2*b*.

A crescent-shaped lubricating oil channel 65 is formed on the outer circumference of the lower journal 1*j*' of the crankshaft 1 supported by the bearing boss 5. The lubricating oil channel 65 can communicate with the oil passage entrance 61. A lubricating oil passage 66 is bored through the crankshaft 1 and extends from the oil passage entrance 61 to the outer circumference of the crankpin 1*p*.

Provided in the crankcase main body 2*a* is an oil pressure detection hole 67 communicating with the outlet port 60. An oil pressure sensor 68 is attached to the crankcase main body 2*a* so that a pressure receiving part of the oil pressure sensor 68 faces the oil pressure detection hole 67. The output terminal of the oil pressure sensor 68 is connected to an alerting device 69 formed from an alerting lamp, a buzzer, etc. When the discharge pressure of the oil pump 32 drops to a predetermined value or below, the oil pressure sensor 68 can detect this and then operate the alerting device 69.

As shown in FIGS. 1 and 3, the forward end of the support shaft 45 projects from the outside face of the oil slinger 31. The projecting end is fitted with a centrifugal governor 71, which controls a throttle valve (not illustrated) via a link mechanism 70.

In FIG. 6, La and Lb denote the upper and lower limit levels of the liquid level of the oil reservoir 30, the liquid level being indicated by an oil gauge.

The action of the embodiment is explained below.

When the engine E is in operation, the rotation of the crankshaft 1 is transmitted from the drive gear 34 to the driven gear 35, and the driven gear 35 directly drives the oil slinger 31 and also drives the inner rotor 41 of the oil pump 32 via the pump drive shaft 42. The rotation of the oil slinger 31 splashes the oil O within the oil reservoir 30, and the splashed oil is scattered not only within the crankcase 2 but also in the belt passage 28 and the valve operation chamber 23, thereby lubricating each of the sections within the engine E. In other words, the oil slinger performs splash-lubrication.

The rotation of the oil pump inner rotor 41, in cooperation with the outer rotor 40, creates a vacuum drawing in oil from the oil reservoir 30 via the intake port 46 and discharges the oil via the discharge port 50 into the first oil pipe 51. The oil is then fed by pressure to the oil filter 56, purified, and then fed by pressure via the second oil pipe 52 through the oil passage entrance 61 into the lubricating oil channel 65 and the lubricating oil passage 66, thereby providing forced lubrication to only the lower journal 1*j*' and the crankpin 1*p* of the crankshaft 1.

Even if the extent to which the oil slinger 31 is immersed in the oil O decreases when the engine E is operated in a tilted state, and the amount of splashed oil decreases, the oil pump 32, which is completely immersed in the oil O within the oil reservoir 30, operates so as to continuously supply the oil to the lubricating oil channel 65 and the lubricating oil passage 66 of the crankshaft 1. It is therefore still possible to provide forced lubrication around the lower journal 1*j*' and the crankpin 1*p*, which receive particularly high loads. As a result, the engine can be operated continuously without a problem. This means that it is possible to set the amount of oil stored in the oil reservoir 30 as small as possible without taking the tilt attitude of the engine E into consideration, thereby reducing the loss in motive power due to the resistance in stirring of the oil slinger 31.

Although a small amount of the oil O within the oil reservoir 30 is consumed during operation of the engine E, after a long run, the liquid level of the oil reservoir 30 might drop below the alert level Lc, which is lower than the lower limit level Lb. In such a state, the leak hole 53 of the oil pump 32, which communicates with the intake port 46, is exposed above the liquid level of the oil reservoir 30. Consequently, air is taken into the crankcase 2 through the leak hole 53, thus decreasing the pump efficiency and thereby making the discharge pressure equal to or less than the predetermined value. The oil pressure sensor 68 detects such a state, operates the alerting device 69, and informs the operator of the need for the oil reservoir 30 to be replenished with oil.

Although the amount of oil supplied to the crankshaft 1 thus decreases due to the reduction in pump efficiency of the oil pump 32, this does not cause a problem with the forced lubrication of the crankshaft 1. Moreover, since the lower end of the oil slinger 31 is positioned beneath the leak hole 53 by the predetermined distance e, the oil slinger 31 continuously splashes oil to some extent, thereby continuing the splash-lubrication. It is therefore possible to operate the engine E for a short time thereafter.

Since the oil pump 32 is employed only for lubricating around the lower journal 1*j*' and the crankpin 1*p* of the crankshaft 1, the oil pump 32 only requires a comparatively small capacity, and therefore, can be obtained at a low cost. Moreover, since the oil pump 32 is driven using the transmission system 33 that drives the oil slinger 31, it is unnecessary to employ a dedicated transmission system for the oil pump 32. It is therefore possible to effectively avoid an increase in the cost of the engine despite the combined use of forced lubrication.

Furthermore, since the first oil pipe 51 which guides oil from the oil pump 32 to the oil filter 56, the second oil pipe 52 which guides oil from the oil filter 56 to the crankshaft 1, and the joints thereof are all arranged within the crankcase 2, even when there is oil leakage from the first and second oil pipes 51 and 52 and the joints thereof, the leaked oil is returned immediately to the oil reservoir 30, thereby reliably preventing the leakage to the outside.

Furthermore, since the entrance 46*a* of the intake port 46 of the oil pump 32, which is covered with the oil strainer 47, is raised from the bottom of the oil reservoir 30 by a fixed distance and is surrounded by the rib 48, the load imposed on the oil strainer 47 can be lightened while preventing the intake of foreign substances residing on the bottom of the oil reservoir 30.

Although an embodiment of the present invention has been explained in detail above, the present invention can be modified in a variety of ways without departing from the spirit and scope of the present invention.

What is claimed is:

1. An engine lubrication system for lubricating the interior of an engine having a crankshaft, a crankcase supporting the crankshaft, and a transmission operably connected to the crankshaft, the engine lubrication system comprising a base of the crankcase forming an oil reservoir, a lubricating-oil passage within the crankshaft, an oil slinger driven by the crankshaft through the transmission, and an oil pump driven by the crankshaft through the transmission, wherein a part of the oil slinger is immersed in oil within the oil reservoir, and lubricates the interior of the engine with oil splashed from the oil slinger during rotation of the oil slinger and wherein the oil pump is immersed in the oil within the oil reservoir, the oil pump having a discharge port communicating with the lubricating-oil passage within the crankshaft.

2. The engine lubrication system claim 1, wherein the crankcase includes an oil filter having a purified chamber and an unpurified chamber, the lubrication system including a first oil pipe and a second oil pipe disposed within the crankcase, the first oil pipe connecting the discharge port of the oil pump to an inlet port of the crankcase, the inlet port communicating with the unpurified chamber of the oil filter, the second oil pipe connecting the lubricating-oil passage to an outlet port of the crankcase, the outlet port communicating with the purified chamber of the oil filter.

3. The engine lubrication system according to claim 1, wherein the oil slinger is arranged so that a lower end thereof is positioned beneath the leak hole.

4. The engine lubrication system according to claim 2, wherein the second oil pipe is bent and a middle section thereof is supported by a support piece fixed to the crankcase.

5. The engine lubrication system according to claim 2, wherein the oil pump has an intake port, and an entrance of the intake port is open toward a bottom of the oil reservoir and is equipped with an oil strainer.

6. The engine lubrication system according to claim 5, wherein a rib having a notch is provided on the bottom of the oil reservoir and surrounds the entrance of the intake port, and oil is admitted into the oil reservoir through the notch.

7. The engine lubrication system according to claim 1, wherein the oil pump has a relief valve that opens to relieve excess pressure in the discharge port and releases the excess pressure into the crankcase.

* * * * *